US007491278B2

(12) United States Patent
Kröpfl

(10) Patent No.: US 7,491,278 B2
(45) Date of Patent: Feb. 17, 2009

(54) METHOD OF HEAT TREATING AN ALUMINIUM ALLOY MEMBER AND APPARATUS THEREFOR

(75) Inventor: Ingo Günther Kröpfl, Polch (DE)

(73) Assignee: Aleris Aluminum Koblenz GmbH, Koblenz (DE)

( * ) Notice: Subject to any disclaimer, the term of this patent is extended or adjusted under 35 U.S.C. 154(b) by 389 days.

(21) Appl. No.: 11/239,477

(22) Filed: Sep. 30, 2005

(65) Prior Publication Data

US 2006/0070689 A1 Apr. 6, 2006

Related U.S. Application Data

(60) Provisional application No. 60/616,228, filed on Oct. 7, 2004.

(30) Foreign Application Priority Data

Oct. 5, 2004 (EP) ..... 04077719

(51) Int. Cl.
*C22F 1/04* (2006.01)

(52) U.S. Cl. ..... 148/688; 148/689; 148/690; 148/698; 148/703

(58) Field of Classification Search ..... None
See application file for complete search history.

(56) References Cited

U.S. PATENT DOCUMENTS

| | | | | |
|---|---|---|---|---|
| 3,135,633 | A * | 6/1964 | Hornus | 148/695 |
| 4,294,625 | A * | 10/1981 | Hyatt et al. | 148/550 |
| 5,258,081 | A * | 11/1993 | Peel et al. | 148/437 |
| 5,662,750 | A * | 9/1997 | Shen | 148/690 |
| 5,718,780 | A * | 2/1998 | Bryant et al. | 148/688 |
| 5,728,241 | A | 3/1998 | Gupta et al. | |
| RE36,692 | E | 5/2000 | Gupta et al. | |
| 6,406,571 | B1 * | 6/2002 | Gupta et al. | 148/697 |
| 2002/0174920 | A1 * | 11/2002 | Gupta et al. | 148/537 |
| 2003/0015261 | A1 * | 1/2003 | Bull et al. | 148/551 |

FOREIGN PATENT DOCUMENTS

DE 908735 4/1954

(Continued)

OTHER PUBLICATIONS

"Aluminum Mill and Engineered Wrought Products: Physical Metallurgy", in vol. 2: Properties and Selection: Non-Ferrous Alloys and Special-Purpose Materials, ASM Handbook, Copyright 1990.*

(Continued)

*Primary Examiner*—Roy King
*Assistant Examiner*—Mark L Shevin
(74) *Attorney, Agent, or Firm*—Novak Druce + Quigg, LLP

(57) ABSTRACT

Disclosed is a method of heat treating an aluminum alloy member having a main surface, including the steps of (a) subjecting the member to a solution heat treatment (b) quenching the member and (c) reheating the member in a pre-ageing heat treatment step. The pre-ageing heat treatment is conducted by holding the aluminum alloy member close to a heating plate. Also disclosed is a product produced according to this method, and to an apparatus for performing the pre-ageing heat treatment.

41 Claims, 2 Drawing Sheets

FOREIGN PATENT DOCUMENTS

| | | | |
|---|---|---|---|
| DE | 10043562 | | 3/2001 |
| EP | 0480402 | | 4/1992 |
| EP | 0679199 | | 11/1995 |
| EP | 0801141 | A1 * | 10/1997 |
| EP | 0805879 | | 11/1997 |
| GB | 292690 | | 6/1928 |
| GB | 1258147 | * | 12/1971 |
| GB | 2152402 | | 5/1995 |
| WO | 9514113 | | 5/1995 |
| WO | 0051170 | | 8/2000 |

OTHER PUBLICATIONS

Layt; "*Dianella tasmanica* flax lily 'TR20,'" *Plant Varieties Journal* 16 (4): 122 (Feb. 6, 2004).

Layt; "*Dianella tasmanica* flax lily 'TR20,'" *Plant Varieties Journal* 17 (1): 603-605 (Apr. 28, 2004).

Australian Government, IP Australia, Plant Breeder's Rights; Database entry for Australian Plant Breeders Right Application No. 2003/290; Variety 'TR20' http://pbr.ipaustralia.optus.com.au/docs/2003290.doc.

Office Action issued Mar. 24, 2006 in corresponding German Application No. 10 2005 045 340.

* cited by examiner

METHOD OF HEAT TREATING AN ALUMINIUM ALLOY MEMBER AND APPARATUS THEREFOR

CROSS-REFERENCE TO RELATED APPLICATIONS

This claims priority from U.S. provisional patent application No. 60/616,228 filed Oct. 7, 2004 and European patent application no. 04077719.5 filed Oct. 5, 2004, both incorporated herein by reference in their entirety.

FIELD OF THE INVENTION

This invention relates to a method of heat treating an aluminium alloy member, comprising a pre-ageing heat treatment step, and an apparatus therefor.

BACKGROUND OF THE INVENTION

Aluminium alloy members made of heat-treatable aluminium alloys are used in a number of applications involving relatively high strength, high toughness and corrosion resistance such as aircraft fuselages, vehicular members and other applications.

To manufacture an aluminium alloy member, for example a sheet or plate, aluminium alloy is either direct chill cast as ingots or continuous cast in the form of a thick strip material, and then hot rolled and/or cold rolled to the desired thickness. The member then undergoes solution heat treatment. Solution heat treatment involves heating the metal to a suitably high temperature (e.g. 450-580° C.) to cause dissolution into solid solution of all the soluble alloying constituents that precipitated from the parent metal during hot and/or cold rolling. To retain these constituents in solid solution, the metal is rapidly quenched to ambient temperature to create a solid supersaturated solution. Usually, the metal is then aged or precipitation hardened by holding the metal at room temperature, or at a higher temperature to accelerate the effect, for a period of time to cause the spontaneous formation of fine precipitates through the diffusion of atoms in the supersaturated solid solution, whereby they form fine clusters or "zones".

It is further known that the properties of an aluminium alloy member may be further improved by subjecting the member to a further heat treatment after quenching. During this so called "pre-ageing" heat treatment, some of the atoms in the supersaturated solid solution come out of the lattice structure and form seeds for the formation of fine clusters. This serves to stabilize the microstructure.

U.S. Pat. No. 3,135,633 discloses such a pre-ageing or "stabilizing" heat treatment to improve the mechanical properties of aluminium-magnesium-silicon alloys. In this process, wrought alloyed products are moved continuously through a first furnace to put the relevant alloying elements into solid solution, then through a quenching chamber and into a second furnace to be subjected to a stabilizing pre-ageing treatment. It is mentioned that the time interval between quenching and preliminary ageing should be less than ten minutes. To allow for rapid heating-up of the alloy, starting a few minutes after quenching, the second furnace is heated by forced hot air circulation.

A pre-ageing heat treatment is further described in EP-0805879-B1. In the disclosed method the metal is heated directly to a peak temperature in the range of 100 to 300° C., preferably in the range of 130 to 270° C., is maintained at the peak temperature for a very short dwell time and is then cooled directly to below a defined final temperature. This treatment is therefore also referred to in the art as temperature "spiking", since the profile of the temperature versus time graph for such a process resembles a generally triangular, pointed, or slightly blunted spike. The treatment is reported to improve the ductility of alloys of a AA6xxx-series in the T4 temper while maximizing the paint bake response.

Another process involving a pre-ageing heat treatment is disclosed in EP-0480402-A1. The known process involves quenching an aluminium alloy sheet after solution heat treatment, allowing the sheet to hold still at room temperature for less than 60 minutes, and holding the sheet at a temperature of 50-150° C. for a period of from 10-500 minutes.

EP-0679199-A1 also discloses a pre-ageing or pre-tempering step at a temperature of 70 to 150° C. in between the quenching after solution heat treatment and ageing steps.

SUMMARY OF THE INVENTION

It is a preferred object of the present invention to further improve heat treatment methods for aluminium alloy members in order to further the properties of the final product.

It is a further object to simplify the apparatus required to carry out the heat treatment, in particular the pre-ageing treatment after solution heat treatment.

The present invention solves preferably one or more of the above-mentioned objects. Preferred embodiments are described and specified by this specification.

The present invention relates to a method of heat treating an aluminium alloy member having a main surface, including the steps of (a) subjecting the member to a solution heat treatment (b) quenching the member and (c) reheating the member in a pre-ageing heat treatment step. The pre-ageing heat treatment is conducted by holding the aluminium alloy member close to a heating plate. The invention is also directed to a product produced according to this method, and to an apparatus for performing the pre-ageing heat treatment.

DETAILED DESCRIPTION OF THE PREFERRED EMBODIMENTS

As will be appreciated herein below, except as otherwise indicated, all alloy designations and temper designations refer to the Aluminum Association designations in Aluminum Standards and Data and the Registration Records, as published by the Aluminum Association.

According to one aspect of the invention there is provided a method of heat treating an aluminium alloy member having a main surface, the method comprising the steps in succession of a) subjecting the member to a solution heat treatment, b) quenching the member, preferably by one of spray quenching or immersion quenching in water or other quenching media, and c) reheating the quenched member in a pre-ageing heat treatment step, and whereby the pre-ageing heat treatment is conducted by coupling the main surface of the aluminium alloy member to a main surface of a heating plate.

The invention is based on the realisation that the pre-ageing heat treatment is particularly effective when if it is performed directly after the quenching step of the member terminating the solution heat treatment to obtain a more stabilised microstructure of the aluminium alloy member without substantial natural age hardening taking place. More preferably, the pre-ageing treatment is carried out within one hour of the quenching step and the time delay is usually reduced to a matter of minutes and possibly even to seconds. For this reason, conducting the heat treatment in a furnace will not yield ideal results, because the member has to be moved into the furnace, and will take some time to reach the desired temperature. The invention therefore proposes a method without utilising a furnace for the pre-age treatment of the aluminium alloy member as the pre-aging treatment is carried out outside any furnace. Instead of a furnace, the aluminium alloy member is held close to or coupled to a heating plate and is thereby rapidly heated up to achieve a pre-ageing treatment. The maximum pre-ageing temperature may be reached within a few minutes, since heat is transferred from the heating plate to the aluminium alloy member. The heating plate is preferably already heated up to the desired temperature prior to the pre-ageing step.

The aluminium alloy member on which this method is performed is preferably a rolled product, typically a thin plate or a sheet having a thickness of at most 15 mm and preferably in the range of 1.5 to 6 mm.

The method may be used for the treatment of any heat-treatable aluminium alloy, in particular those of the AA6xxx, AA2xxx, or AA7xxx-series aluminium alloys. Most preferred, the aluminium alloy member is selected from the group consisting of AA6013, AA6056, AA6011, AA6016, AA2024, AA2524, AA2219, AA7074, AA7075, AA7050 and AA7055.

The heating plate is preferably also made of an aluminium alloy having a large heat capacity and a higher melting point relative to the heat treated aluminium alloy member. In particular aluminium alloys of the AA5xxx-series, such as for example AA5026, and the AA3xxx-series can be used. In this embodiment the thickness of the heating plate is at least the thickness of the thickness of the aluminium alloy member. The skilled person will be able to optimize the thickness of the heating plate depending of the thickness of the aluminium alloy member and the desired pre-ageing treatment temperature and time.

In another embodiment the heating plate is made from a steel.

There are several ways of heating up the heating plate prior to the pre-ageing step. In an embodiment, the heating plate is being placed in the furnace used for the solution heat treatment together with the aluminium alloy member. This method has the advantage that no extra equipment or time is needed to heat up the heating plate. Preferably, the aluminium alloy member and the heating plate are both held substantially horizontal, and the aluminium alloy member is simply placed on top of the heating plate before entering the furnace used for solution heat treatment.

Preferably, the heating plate and the member are held with their main surfaces close to each other during all three steps of solution heat treatment, quenching and pre-ageing. This means that the member may be quenched by spraying or cooling from one side only. However, this has the advantage that the member will be re-heated to achieve a pre-ageing treatment immediately after quenching has been finished by a heat flow from the non-quenched heating plate to the aluminium alloy member.

Alternatively, the aluminium plate is quenched on both sides and it is placed on the heating plate to achieve the desired pre-ageing treatment.

Alternatively, the heating plate may be placed in the furnace used for the solution heat treatment before the aluminium alloy member is solution heat treated. Once it has been heated up, the heating plate may be kept near the quenching apparatus during the solution heat treatment and quenching of the aluminium alloy member. Since the maximum temperature of the pre-ageing treatment is typically lower than the temperature of the solution heat treatment, it may even be advantageous to let the heating plate cool down before it receives the aluminium alloy member. After quenching, the aluminium alloy member is preferably lifted on top of the heating plate.

A further alternative concerns heating the heating plate electrically, for example by means of heating coils disposed inside the heating plate. In this embodiment, it is preferred to heat up the plate to the desired pre-ageing temperature before the pre-ageing heat treatment is conducted.

The usual way to hold the main surface of the aluminium alloy member close to a main surface of the heating plate will be to place them horizontally one on top of the other. However, arrangements in which the member and plate are vertically aligned are not excluded from the scope of protection.

In order to protect the surface of the aluminium alloy member and to ensure a small gap between the heated plate and the aluminium alloy member, a protective layer is placed between each aluminium alloy member and each heating plate to couple them together. This layer has a thickness preferably up to 5 mm, and typically a thickness of about 2 mm, and is made from a cloth or web made of an isolating material such as glass fabric, ceramics, glass wool, mineral wool or, for lower temperatures, a polymer fabric. The use of the protective layer will also result into a small delay of the reheating of the aluminium alloy member resulting that in the quenching operation the member is allowed to cool down fast to below 100° C. prior to receiving the heat from the heating plate to achieve a pre-ageing heat treatment.

It is also possible to use more than one heating plate. In a preferred embodiment, the aluminium alloy member is held sandwiched between two heating plates during the pre-ageing step. This arrangement serves to straighten the member, so that no further levelling or stretching operation may be required.

According to an alternative embodiment, two aluminium alloy members are being heat treated at the same time by being held close to opposite sides of one heating plate.

The pre-ageing treatment according to the invention is carried out prior to bringing the aluminium alloy member to its final temper by means of artificial ageing. Typical final temper would be a temper selected from the group comprising T6, T79, T78, T77, T74, T73 and T8. By means of example, a suitable T73 temper would be a T7351 temper, and a suitable T74 temper would be the T7451 temper.

In an embodiment after the pre-ageing treatment and prior to the final ageing treatment the aluminium alloy member may optionally be stretched or compressed or otherwise cold worked to relieve stresses or to improve mechanical properties, for example levelling of the sheet or thin plate products. Preferably the stretching operation involves not more than 8% of the length just prior to the stretching operation, and is preferably in a range of 1 to 5%. In particular aluminium alloy members of the AA6xxx-and AA2xxx-series alloys can be subjected also to a cold rolling operation with a cold rolling reduction in a range of up to 20% to improve achievable mechanical properties in the final temper.

In another aspect the invention relates to a product obtained by the method according to this invention. The final product may for example be used for the outer skin of aircraft fuselages.

The invention in another aspect provides an apparatus for heat treating an aluminium alloy member comprising: a) a solution heat treatment furnace, b) a quenching station, c) a heating plate for reheating the member in a pre-ageing heat treatment step by coupling a main surface of the member to a main surface of the heating plate. This apparatus has the advantage that it does not require a second furnace for the pre-ageing heat treatment.

BRIEF DESCRIPTION OF THE DRAWINGS

The above-mentioned and further features and advantages of the heat treatment method according to the invention will become apparent from the following detailed description of preferred embodiments, with reference to the appended drawings, in which.

DETAILED DESCRIPTION OF THE DRAWINGS

Figure 1:
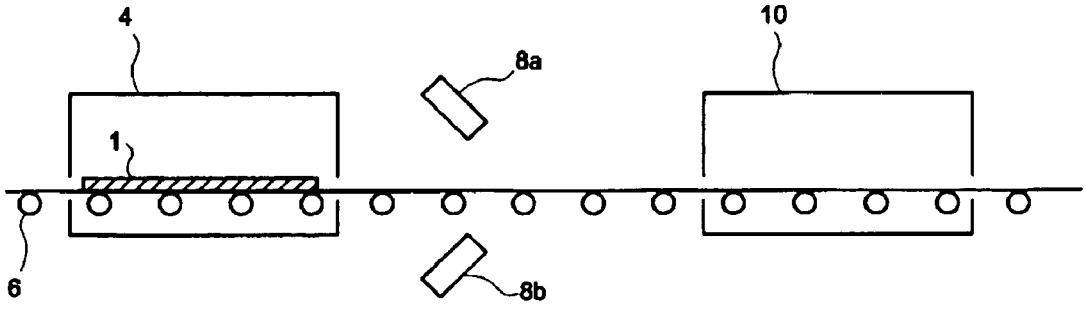
Fig. 1 (Prior Art)
FIG. 1 is a schematic representation of a heat treatment facility according to the prior art.

FIG. 1 shows a state of the art facility for heat treating an aluminium alloy member 1. The member 1 coming from the rolling mill is solution heat treated in a continuous horizontal furnace 4. The member 1 is conveyed through the furnace on rollers 6. After solution heat treatment, the member 1 is quenched by means of nozzles 8*a*, 8*b*, which spray quenching water onto be upper and lower surfaces of the member. In order to reheat the member 1 for the pre-ageing heat treatment, a further horizontal furnace 10 is provided at the end of the line. Hence, the prior art method requires two furnaces. The pre-ageing furnace 10 must be specially equipped with forced hot air circulation to ensure rapid reheating of the member 1.

Figure 2:
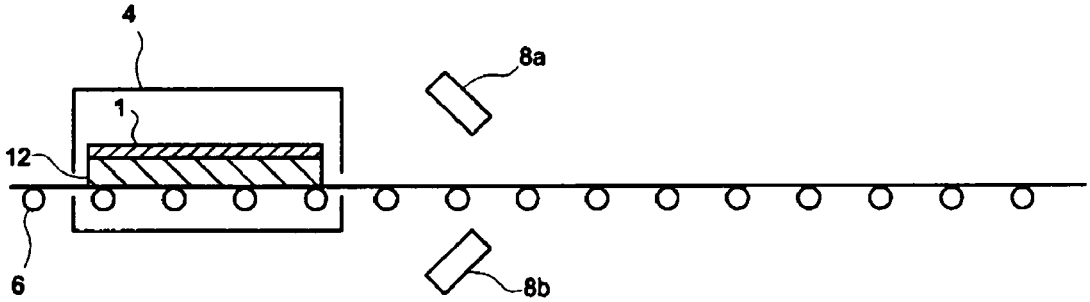
FIG. 2 is a schematic representation of a heat treatment facility using a method according to a first embodiment of the invention.

A facility implementing the method according to the first embodiment of the invention is shown in FIG. 2. The plate 1 coming from the mill is again heat treated in a horizontal furnace 4. However, it is disposed on top of a heating plate 12 during the treatment. After the solution heat treatment, the member 1 remains on the heating plate while undergoing quenching. Hence, only the upper nozzles 8*a* are used to quench member 1. The member/plate arrangement is then further conveyed on rollers 6. Since plate 12 is as thick as or thicker than member 1 and made of a material of high heat capacity and good heat conductivity, plate 12 will reheat the member 1 immediately after quenching has stopped. The heating rate and the maximum temperature reached by the member will depend on the thickness and composition of the heating plate 12 in relation to the thickness and composition of the member 1. Preferably, the heating plate is about 40 mm thick, i.e. thicker than the member 1, and is preferably made of an aluminium alloy of the AA5xxx-series or AA3xxx-series.

Figure 3:
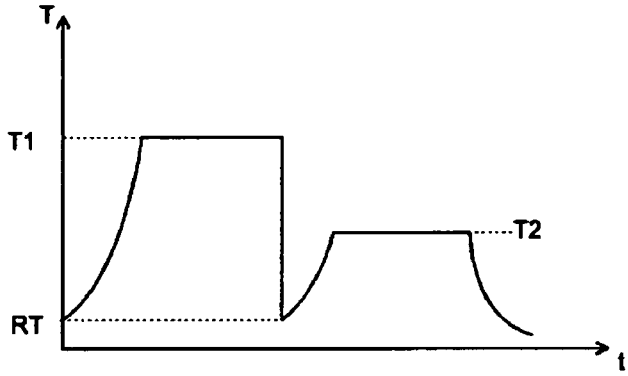
FIG. 3 is a temperature versus time graph for the method according to the first embodiment.

The temperature profile experience by the member 1 is shown in FIG. 3. During the solution heat treatment, the member 1 is heated to a first temperature $T_1$, which is between 450° C. and 580° C., and typically about 530° C. The metal is held at this temperature for some time as known in the art. During quenching, the metal is rapidly cooled down to a temperature of 100° C. or less, preferably to room temperature RT. By subsequently placing the member on top of heating plate 12 as shown in FIG. 2, the member will immediately be reheated to a pre-ageing temperature $T_2$ in the range of 100° C. to 250° C., preferably in the range of 150 to 250° C. The member will reach $T_2$ within a few minutes and will preferably be held at this temperature for a time required to achieve the desired pre-ageing effect, and the holding time would typically be in the range of up the 30 minutes, preferably 10 to 20 minutes. The selected pre-ageing temperature and holding time will be dependent on the alloy composition of the aluminium alloy member. The pre-ageing treatment is finalised by taking off the aluminium alloy member from the heating plate. The member is then cooled down to ambient temperature by means of water cooling, forced air or left on for example a roller table to cool down by free air convention. The cooling rate after the pre-ageing treatment has been found not to be very critical.

Most preferably, reheating to achieve the pre-ageing effect will begin within one or two minutes, preferably within 0 to 20 seconds, after quenching from solution heat treatment. The heating rate is preferably in the range of 10 to 50° C./min., so that the final pre-ageing temperature will be reached within 1 to 10 minutes, preferably 5 minutes.

Figure 4:
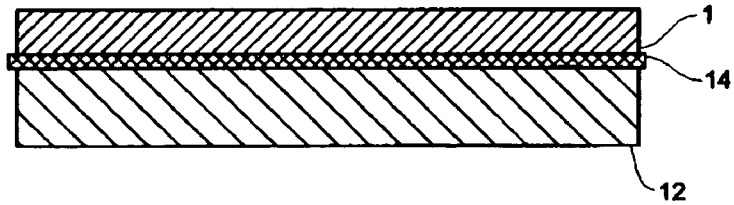
FIG. 4 is a cross sectional view of an arrangement of aluminium alloy member and heating plate according to the first embodiment.

FIG. 4 shows an enlarged cross sectional view of the member/plate arrangement. Between member and plate is disposed a protective layer 14 to space the member 1 and the plate 12 from each other, and to provide a heat isolating layer between the member 1 and the plate 12. Preferably, the protective layer 14 is about 2 mm thick and made of a heat isolating fabric such as glass fabric, glass wool, mineral wool or polymer fabric. However, any other material or any other suitable type of spacer may be used as well. Although not shown in FIG. 5 to 7, a protective layer may be present in each case between each member 1 and each heating plate 12.

Figure 5:
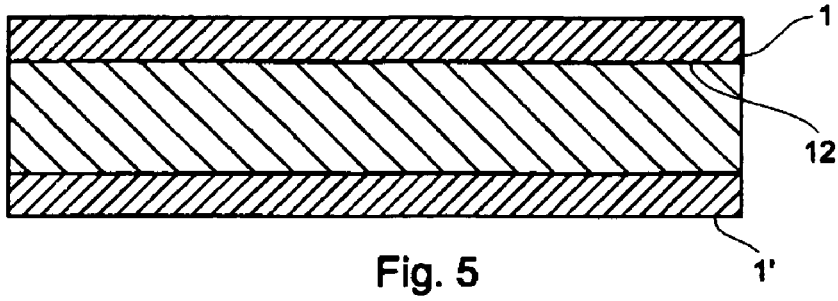
FIG. 5 is a cross sectional view of an arrangement of two members and the heating plate according to a second embodiment.

According to a second embodiment, one heating plate 12 will be sandwiched between two aluminium alloy members 1, 1' as shown in FIG. 5. The arrangement according to FIG. 5 allows the pre-ageing treatment of two members 1, 1' simultaneously. The heating plate 12 must be thick enough to store sufficient heat for re-heating both members to achieve the required pre-ageing treatment.

These first two embodiments are suitable for continuous heat treatment, in which the heating plate(s) and the aluminium alloy member(s) are held adjacent to each other during all steps of solution heat treatment, quenching and pre-ageing.

Figure 6:
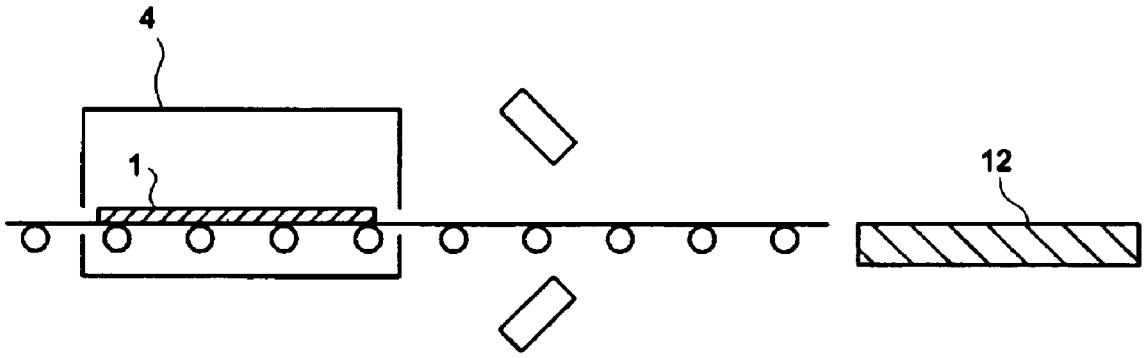
FIG. 6 is a schematic representation of a heat treatment facility using a method according to a third embodiment of the invention

However, it may be advantageous in some applications to heat up the heating plate 12 before the aluminium alloy member 1. This arrangement is shown in FIG. 6. Here, the plate 12 will be heated before the solution heat treatment of member 1 in the horizontal furnace 4 and then placed aside. After quenching, the member 1 will be lifted on top of the heating plate 12. This embodiment has the advantage that the plate 12 may have cooled down to the lower pre-ageing temperature in the range of 100 to 250° C. before receiving the member 1. Alternatively, the member 1 may be fed through the solution heat treatment furnace before the heating plate 12. The embodiment shown in FIG. 6 also allows to use a self-heating plate 12 provided e.g. with electrical coils, which need not be heated up in a furnace.

Figure 7:
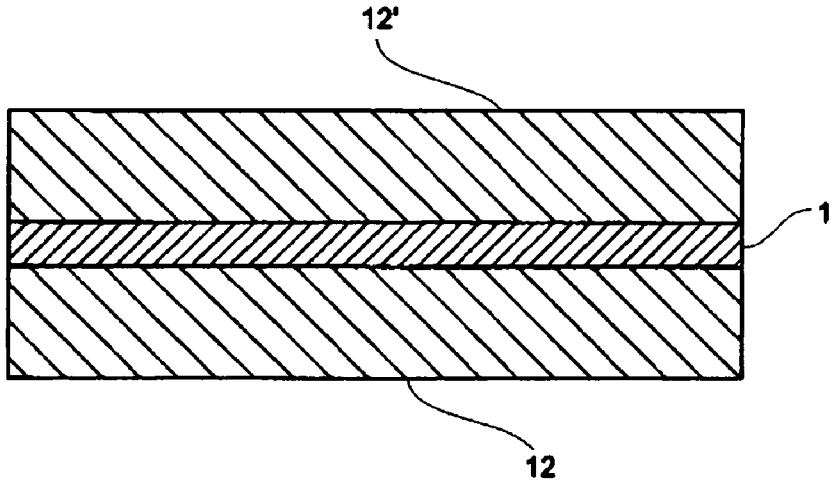
FIG. 7 is a cross sectional view of member/heating plate arrangement according to a further embodiment.

In another embodiment shown in FIG. 7, two heating plates 12, 12' will be heated prior to the pre-ageing step, and one heating plate 12' will be placed on top of member 1. This will straighten the member 1, so that further stretch forming may not be necessary.

After the member has cooled down to ambient temperature the member will undergo a further ageing treatment to produce an age-hardened material with the desired set of properties for its application.

Having now fully described the invention, it will be apparent to one of ordinary skill in the art that many changes and modifications can be made without departing from the spirit or scope of the invention as hereon described.

The invention claimed is:

1. A method of heat treating an aluminum alloy member having a main surface, comprising the steps of:

a) subjecting the member to a solution heat treatment, b) quenching the member, c) reheating the quenched member in a pre-ageing heat treatment step, and wherein the pre-ageing heat treatment comprises coupling the main surface of the member to a main surface of a heating plate, wherein the pre-ageing treatment is carried out outside any furnace, and wherein the aluminum alloy member and the heating plate are coupled to each other by placing a protective layer between the aluminum alloy member and the heating plate, wherein the protective layer is made from an isolating material selected from the group consisting of glass fabric, ceramics, glass wool, mineral wool, and polymer fabric.

2. The method according to claim 1, wherein the aluminum alloy member and the heating plate are held substantially horizontally, one on top of the other, during the pre-ageing heat treatment.

3. The method according to claim 1, wherein the aluminum alloy member and the heating plate are coupled to each other during all of steps (a) to (c).

4. The method according to claim 1, wherein the heating plate is electrically heated before and/or during the pre-ageing step.

5. The method according to claim 1, wherein the heating plate is heated before the pre-ageing step by being placed in a furnace used for the solution heat treatment.

6. The method according to claim 1, wherein the aluminum alloy member is lifted onto the heating plate after the quenching step.

7. The method according to claim 1, wherein the protective layer has a thickness up to 5 mm.

8. The method according to claim 1, wherein a second aluminum alloy member is coupled with one of its main surfaces close to a second main surface of the heating plate during the pre-ageing step.

9. The method according to claim 1, wherein the aluminum alloy member is held sandwiched between two heating plates during the pre-ageing step.

10. The method as claimed in one of the preceding claims, wherein the heating plate is at least as thick as the aluminum alloy member.

11. The method according to claim 1, wherein the aluminum alloy member is a rolled product.

12. The method according to claim 1, wherein the aluminum alloy member is a rolled product having a thickness of at most 15 mm.

13. The method according to claim 1, wherein the aluminum alloy member is a rolled product having a thickness of at most 6 mm.

14. The method according to claim 1, wherein the aluminum alloy member is a rolled product having a thickness in the range of 1.5 to 6 mm.

15. The method according to claim 1, wherein the aluminum alloy member is composed of a heat-treatable aluminum alloy of the AA2xxx, AA6xxx or AA7xxx series.

16. The method according to claim 1, wherein the aluminum alloy member is composed of a heat-treatable aluminum alloy of the AA6xxx-series.

17. The method according to claim 1, wherein the aluminum alloy member is composed of a heat-treatable aluminum alloy selected from the group consisting of AA2024, AA2524, AA2219, AA6013, AA6056, AA6011, AA6016, AA7074, AA7075, AA7055, and AA7050.

18. The method according to claim 1, wherein the aluminum alloy member is composed of a heat-treatable aluminum alloy selected from the group consisting of AA6013, AA6056, AA6011, and AA6016.

19. The method according to claim 1, wherein the aluminum alloy member is an outer skin of an aircraft fuselage.

20. The method according to claim 1, wherein the heating plate has a larger heat capacity and a higher melting point relative to the aluminum alloy member.

21. The method according to claim 1, wherein the heating plate is made from an AA5xxx-series aluminum alloy.

22. The method according to claim 1, wherein the heating plate is made from an AA3xxx-series aluminum alloy.

23. The method according to claim 1, wherein the heating plate is made from steel.

24. The method according to claim 1, wherein during step b) the member is quenched to a temperature of 100° C or less.

25. The method according to claim 1, wherein step c) starts within 2 minutes after quenching from solution heat treatment.

26. The method according to claim 1, wherein step c) starts within 20 seconds after quenching from solution heat treatment.

27. The method according to claim 1, wherein the maximum temperature of the pre-ageing heat treatment is reached within 1 to 10 minutes or less after quenching.

28. The method according to claim 1, wherein the pre-ageing treatment is carried out at a temperature in a range of 100 to 250° C.

29. The method according to claim 1, wherein the pre-ageing treatment is carried out at a temperature in a range of 150 to 250° C.

30. The method according to claim 1, wherein during the pre-ageing heat treatment step c) the aluminum alloy member is held at a pre-ageing temperature for a holding time of at most 30 minutes.

31. The method according to claim 1, further comprising the step of artificial ageing to a final temper of the aluminum alloy member which has been subjected to the pre-ageing heat treatment step (c).

32. The method according to claim 1, further comprising the step of artificial ageing to a final temper of the aluminum alloy member which has been subjected to the pre-ageing heat treatment step c), and wherein the final temper is selected from the group consisting of T6, T79, T78, T77, T74, T73, and T8.

33. The method according to claim 1, further comprising a step selected from the group consisting of stretching, compressing, and leveling, carried out after the pre-ageing heat treatment step.

34. The method according to claim 1, further comprising a step selected from the group consisting of stretching, compressing, and leveling, carried out after the pre-ageing heat treatment step and prior to artificial ageing to a final temper of the aluminum alloy member.

35. The method according to claim 1, further comprising a stretching operation by not more than 8%, said stretching operation being carried out after the pre-ageing heat treatment step.

36. The method according to claim 1, further comprising a stretching operation in a range of 1 to 5%, said stretching operation being carried out after the pre-ageing heat treatment step.

37. The method according to claim 1, further comprising a step of cold rolling carried out after the pre-ageing heat treatment step and prior to artificial ageing to a final temper of the aluminum alloy member.

38. The method according to claim 1, further comprising a step of cold rolling with a cold rolling reduction in a range of up to 20% carried out after the pre-ageing heat treatment step and prior to artificial ageing to a final temper of the aluminum alloy member.

39. The method according to claim 1, wherein the pre-ageing heat treatment comprises coupling the main surface of the member to a main surface of at most one heating plate.

40. The method according to claim 39, wherein a second aluminum alloy member is coupled with one of its main surfaces close to a second main surface of the heating plate during the pre-ageing step.

41. The method according to claim 40, wherein the heating plate is held sandwiched between the two aluminum alloy members during the pre-ageing step.

* * * * *